US011168694B2

(12) United States Patent
Becker et al.

(10) Patent No.: US 11,168,694 B2
(45) Date of Patent: Nov. 9, 2021

(54) VARIABLE-DELIVERY PUMP DEVICE AND CIRCUIT INCLUDING SUCH A PUMP

(71) Applicant: SOGEFI AIR & COOLING, Guyancourt (FR)

(72) Inventors: Nicolas Becker, Porte-du-Ried (FR); Alexandre Floranc, Logelheim (FR); Sébastien Brunner, Niederhergheim (FR)

(73) Assignee: SOGEFI AIR & COOLING, Guyancourt (FR)

( * ) Notice: Subject to any disclaimer, the term of this patent is extended or adjusted under 35 U.S.C. 154(b) by 0 days.

(21) Appl. No.: 16/647,400

(22) PCT Filed: Sep. 13, 2018

(86) PCT No.: PCT/FR2018/052241
§ 371 (c)(1),
(2) Date: Mar. 13, 2020

(87) PCT Pub. No.: WO2019/053377
PCT Pub. Date: Mar. 21, 2019

(65) Prior Publication Data

US 2021/0148367 A1 May 20, 2021

(30) Foreign Application Priority Data

Sep. 18, 2017 (FR) ..... 17 58627

(51) Int. Cl.
*F04D 15/00* (2006.01)
*F01P 5/12* (2006.01)

(52) U.S. Cl.
CPC ..... *F04D 15/0027* (2013.01); *F01P 5/12* (2013.01); *F01P 2025/32* (2013.01)

(58) Field of Classification Search
CPC ..... F04D 15/0027; F04D 15/0038; F04D 29/042; F04D 29/043; F04D 29/086;
(Continued)

(56) References Cited

U.S. PATENT DOCUMENTS 4,752,183 A * 6/1988 Sakurai ..... F04D 29/042 415/12
5,169,286 A * 12/1992 Yamada ..... F01P 5/10 277/558

(Continued)

FOREIGN PATENT DOCUMENTS

DE 10 2008 059462 6/2009
DE 10 2008 006451 7/2009

(Continued)

OTHER PUBLICATIONS

International Search Report dated Dec. 3, 2018.

*Primary Examiner* — Grant Moubry
(74) *Attorney, Agent, or Firm* — Ipsilon USA, LLP

(57) ABSTRACT

The subject matter of the present invention is a variable-delivery pump device comprising a pump body (2), an impeller (5) and a shut-off element (8) capable of translational movement and adjustably covering at least part of the outer periphery of the impeller (5), as well as a cam element (9) which is rotationally driven and engages with said shut-off element (8) for effecting the translational movement thereof. The pump device (1) is characterized in that the shut-off element (8) and the cam element (9) have cylindrical walls (8') and are arranged concentrically around the housing (7) that accepts the shaft (6) of the impeller (5), and in that the rotary cam element (9) is situated on the inside of the sliding shut-off element (8) and, on the external face of its wall, has at least one helical guideway (11) on which there runs at least one corresponding follower element (12)

(Continued)

secured to the internal face of the wall (8') of the shut-off element (8).

21 Claims, 16 Drawing Sheets

(58) Field of Classification Search
CPC ... F04D 29/468; F01P 5/00; F01P 5/10; F01P 5/12; F01P 2025/32
See application file for complete search history.

(56) References Cited

U.S. PATENT DOCUMENTS 5,800,120 A * 9/1998 Ramsay ..... F04D 15/0038 415/129
6,669,439 B2 * 12/2003 Kardasz ..... F04D 15/0038 415/131
6,796,766 B2 * 9/2004 Hesse ..... F04D 15/0038 415/157
7,082,903 B2 * 8/2006 Hutchins ..... G05D 23/1333 123/41.1
7,186,071 B2 * 3/2007 Pascoe ..... F04D 15/0038 415/131
8,608,452 B2 * 12/2013 Draheim ..... F04D 15/0038 417/212
9,243,649 B2 * 1/2016 Fournier ..... F04D 29/628
9,273,674 B2 * 3/2016 Schmidt ..... F04D 29/466
9,528,521 B2 * 12/2016 Pawellek ..... F04D 13/14
9,932,885 B2 * 4/2018 Devine ..... F04D 29/4213
10,578,006 B2 * 3/2020 Zielberg ..... F01P 7/16
10,731,654 B2 * 8/2020 Zielberg ..... F01P 5/10
2012/0111291 A1 5/2012 Popp
2015/0098804 A1 4/2015 Russalian et al.

FOREIGN PATENT DOCUMENTS

DE 10 2011 076719 12/2012
EP 1589228 10/2005
EP 2 902 631 8/2015
FR 2870898 12/2005

* cited by examiner

VARIABLE-DELIVERY PUMP DEVICE AND CIRCUIT INCLUDING SUCH A PUMP

RELATED APPLICATION

This application is a National Phase of PCT/FR2018/052241 filed on Sep. 13, 2018, which in turn claims the benefit of priority from French Patent Application No. 17 58627 filed on Sep. 18, 2017, the entirety of which are incorporated by reference.

The present invention relates to the field of devices for circulating or pumping liquid fluid using a rotary member, such as an impeller, and its subject is a variable-delivery pump device and a circulation circuit comprising at least one such device.

DESCRIPTION OF THE RELATED ART

Variable-delivery pumps have of course been known for a very long time, particularly in the case of pumps with rotary delivery members provided with vanes or blades.

In most cases, the variations in delivery are obtained by varying the rotational speed of the rotary delivery members, by action on variable-speed electric motors that drive the rotation of same.

However, such motors are relatively expensive and require sophisticated control electronics, making their costs more expensive still, particularly if the delivery is to be adjusted on the basis of a measured parameter, such as the temperature of the fluid for example.

Various systems for varying the delivery of pumps without varying the rotational speed of the rotary delivery member, and therefore without requiring a variable-speed drive motor, have been proposed.

Included among these alternative solutions, mention may be made first of all of those employing flow regulating means situated upstream or downstream of the pump concerned. Nevertheless, these solutions entail controlling a different member, decoupled from the action of the pump and often sited remotely therefrom.

Furthermore, documents FR 2 870 898 and EP 1 589 228 for example disclose variable-delivery pump devices in which the impeller is moved translationally in the longitudinal direction of its axis of rotation, between a deployed position in which the impeller is fully exposed to the stream of the circulating flow and a retracted position in which the impeller is situated out of the circulating stream, for example aside in an indentation. However, these devices entail complex mounting of the impeller, requiring sufficient clearance in the direction of the axial movement, and do not make it possible to obtain a complete cutting-off of the circulation (zero delivery).

Finally, solutions are also known in which a shut-off or isolation means covers from the outside, by fitting over it, the circulation or delivery member, such as an impeller, so as to regulate the degree of interaction of the rotary active delivery or circulation member, notably one having vanes or blades, with the flow of liquid.

Thus, document EP 2 902 631 in particular discloses a variable-delivery pump device comprising, on the one hand, a pump body defining a circulation chamber with at least one inlet and at least one outlet, on the other hand an impeller or similar rotary member fixed to a drive shaft mounted with the ability to rotate in the pump body at a receiving housing, or mounting bearing of substantially cylindrical or discoid overall shape and arranged in the circulation chamber and, finally, a shutter element, able to move in the direction of the longitudinal axis of the shaft of the impeller in the chamber in translation and covering, according to its axial position, adjustably, the exterior periphery of the impeller. In addition, a cam element, driven in rotation by a controlled actuator and collaborating schematically with said shutter element for the translational movement thereof, is also present inside the pump body.

In this known embodiment, the cam element is guided in rotation by the pump body and is situated on the outside of and around the bell-shaped shutter element, the cam element also enclosing a compression spring urging said bell housing into the retracted position in which it does not cover the vaned impeller. This results in a construction with significant radial bulk and requiring a great deal of torque to rotationally move the cam element because of its large external guidance surface.

Documents US 2012/0111291 and DE 10 2008 006451 furthermore disclose pump devices with an impeller, a shutter element for this impeller and a cam element controlling the position of the shutter element. However, these two known embodiments notably exhibit significant axial size and have the functional components distributed across various parts of the body or casing of the pump.

OBJECTS AND SUMMARY

It is an object of the present invention to provide an alternative solution to the one disclosed in EP 2 902 631, which does not have the aforementioned disadvantages and thus makes it possible to overcome at least the chief limitations of the solutions of the other documents mentioned hereinabove.

To this end, one subject of the invention is a variable-delivery pump device of the type mentioned hereinabove and characterized in that the shutter element and the cam element have cylindrical walls and are arranged concentrically around the receiving housing receiving the shaft of the impeller, and in that the rotary cam element extends inside the sliding shutter element and has on the external face of its wall at least one helical guideway on which there circulates at least one corresponding follower element secured to the internal face of the wall of the shutter element, thus, by collaboration, forming a mechanism for converting a rotary movement of the cam element about the longitudinal axis into a translation movement of the shutter element along this axis.

BRIEF DESCRIPTION OF THE DRAWINGS

The invention will be better understood from the following description which relates to preferred embodiments given by way of nonlimiting example and which are explained with reference to the attached schematic drawings (to different scales) in which:

FIGS. 3 to 10 illustrate various constituent components and various steps in the production of the pump device as depicted in FIG. 2, namely:

FIG. 3: a perspective view of a flange forming a means for translationally harnessing the shutter member;

FIG. 5: perspective view of the assembly formed after the objects depicted in FIGS. 3 and 4C have been assembled;

FIG. 8 is an exploded view symbolically illustrating the collaboration between the essential components (cam element/shutter element) of the movement-conversion mechanism that forms part of the pump device depicted in FIG. 6;

FIG. 9 is a partially schematic and perspective view illustrating the drive and operation of the mechanism of FIG. 14;

FIG. 10 is perspective view of an object similar to that of FIG. 6A according to a structural variant of the invention according to the embodiment of FIGS. 7 and 8;

DETAILED DESCRIPTION

Figure 1A:
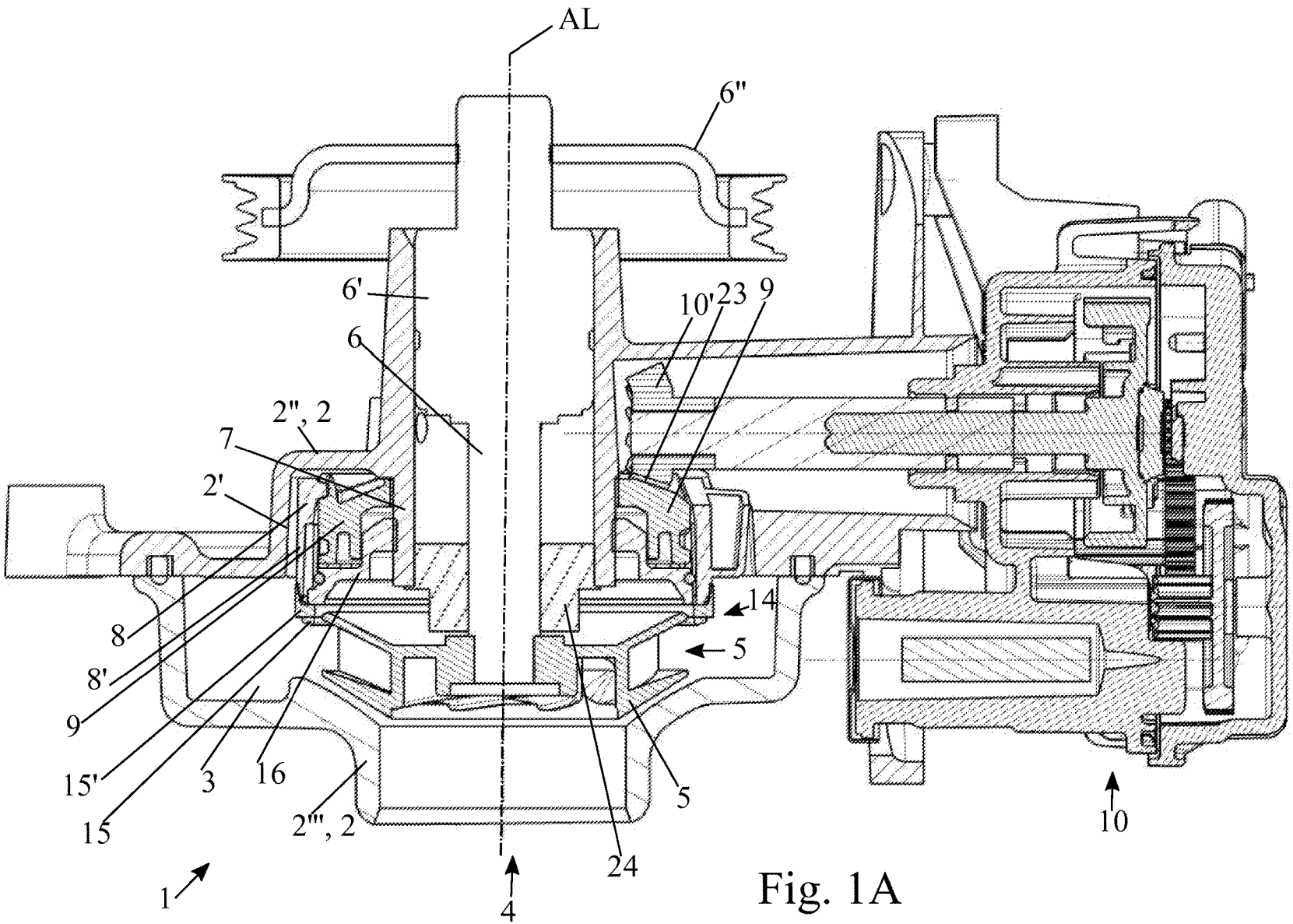
FIGS. 1A and 1B are views in section, on a plane containing the longitudinal axis of the shaft of the impeller, of a variable-delivery pump device according to a first embodiment of the invention, the shutter element being situated respectively in a position of maximum retraction (FIG. 1A) and in a position of maximum deployment (FIG. 1B)

FIGS. 1, 2A and 7 and 12 in particular illustrate a variable-delivery pump device comprising, on the one hand, a pump body 2 defining a circulation chamber 3 with at least one inlet 4 and at least one outlet 4' and, on the other hand, an impeller 5 or similar rotary member fixed to a drive shaft 6 mounted with the ability to rotate in the pump body 2 at a receiving housing 7 for the drive member, this impeller 5 being of discoid overall shape and arranged in the circulation chamber 3 and, finally, a shutter element 8 able to move in translation in the direction of the longitudinal axis AL of the shaft 6 and, according to its axial position, covering adjustably at least part of the exterior periphery 5' of the impeller 5, or not. A cam element 9 is driven in rotation by an actuator 10 and collaborates kinematically with said shutter element 8 for its translation movement inside the pump body 2. What is meant herein by "impeller" is any rotary member able to cause a liquid to circulate or be delivered, normally provided with blades or vanes and having an exterior bulk of discoid or cylindrical shape.

It will be appreciated that such a member has a substantially cylindrical or discoid overall shape and has a circumferential edge defining a circular lateral surface in the form of a band with a determined dimension in the direction of the axis of rotation of the turbine: this peripheral edge corresponds to the "exterior periphery 5" mentioned herein.

According to the invention, the shutter element 8 and the cam element 9 have cylindrical walls 8' and 9' and are arranged concentrically about the receiving housing 7 forming part of the pump body 2 and receiving the shaft 6 of the impeller 5. In addition, the rotary cam element 9 is situated inside the sliding shutter element 8 and has, on the external face 9" of its wall 9' at least one helical guideway 11 on which there circulates at least one corresponding follower element 12 secured to the internal face 8" of the wall 8' of the shutter element 8. These elements 8 and 9 thus, by collaboration, form a mechanism for converting a rotary movement of the cam element 9 about the longitudinal axis AL into a translational movement of the shutter element 8 along this axis AL.

The aforementioned special arrangements profitably lead to a construction that is grouped-together and compact (grouped and overlapping arrangement of the elements 8, 9 and of the shaft of the impeller 5) both axially and radially, all the while enjoying, for a given overall size, a maximum dimension for the shutter element 8 in terms of diameter and simultaneously a maximized possibility of extension of said shutter element 8 beyond the cam element 9, and therefore for covering the periphery 5' of the impeller 5.

Furthermore, by mounting the elements 8 and 9 concentrically around the receiving housing 7 which receives the shaft 6 with rotational guidance, the invention makes it possible to considerably limit the parts and regions of the pump body 2 that require precise manufacture to tight tolerances, and to concentrate these into a limited region (the receiving housing 7).

Of course, the region of mutual engagement of the screw-nut connection between the elements 8 and 9 is confined to a restricted zone of the element 8, advantageously on the opposite side of its free frontal edge 14, so as to have available a height or width of coverage of the impeller 5 by the shutter element 8 in the position of full deployment or extension which is at its maximum for a given size (in the axial direction) of said element 8.

The water pump devices 1 targeted in this instance may be of two types, namely:

- either separate pumps, referred to as "external" pumps which form independent units or modules and of which the pump body (generally made in two parts—a main part 2" and a secondary part 2'"—assembled to one another) on its own delimits the circulation chamber 3,
- or pumps mounted on a support body, for example an engine casing, possibly structurally incorporated into the latter, and collaborating with the latter to form the circulation chamber 3. The pump body then takes the form of a half-shell or bell housing and is secured in a sealed manner to the support body.

Figure 12:
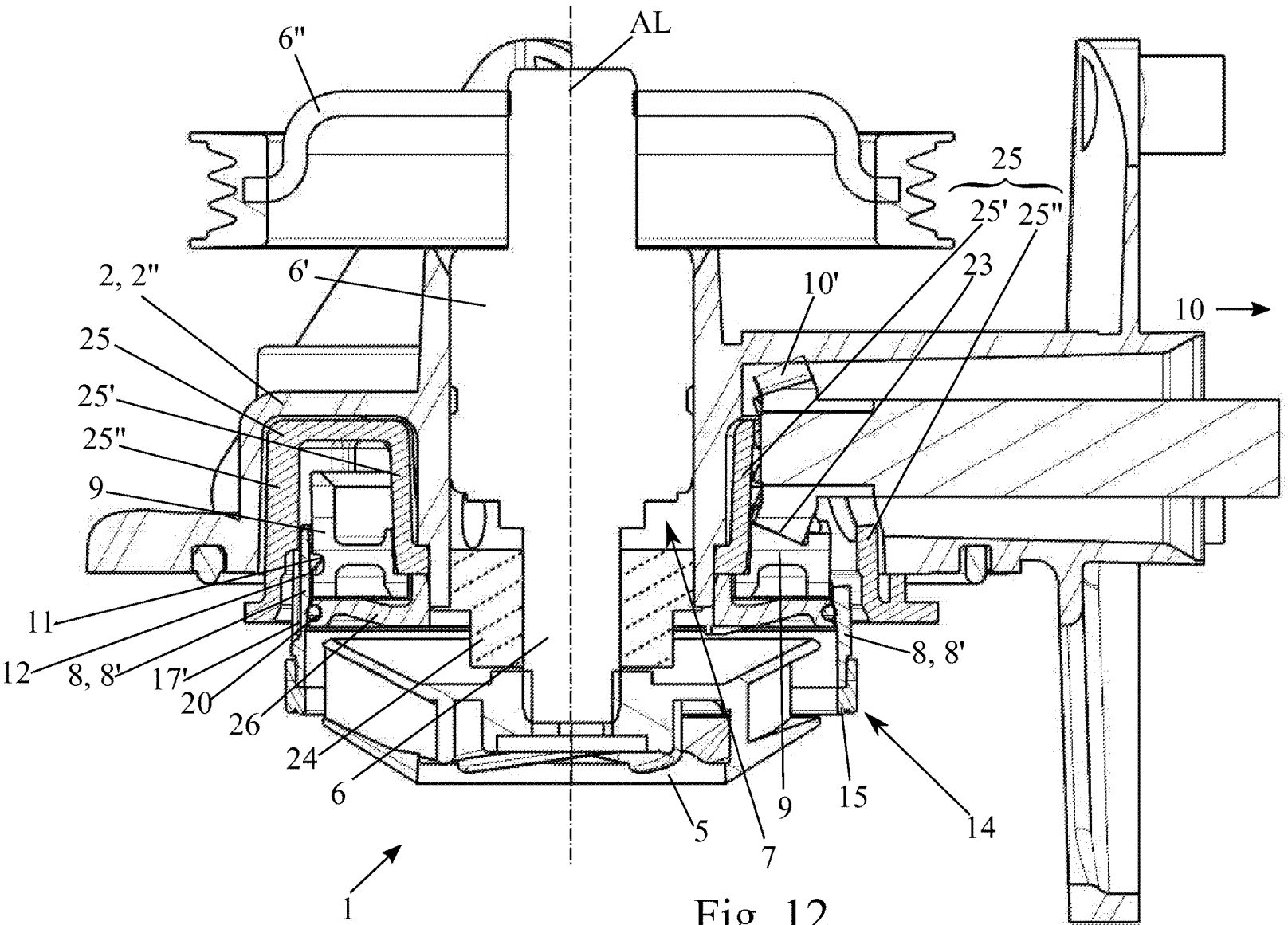
FIG. 12 is a view in section, similar to that of FIGS. 1 and 7, of a third embodiment of the invention, the secondary part of the pump body having being removed.

A person skilled in the art will therefore appreciate that in the attached figures, particularly FIG. 1, the reference 2'" may refer either to part of the body of the pump 2 (complementing the part 2" for example) or to part of a support body, for example an engine casing, and that as a result, the references 2, 2" may refer either to the pump body in its entirety (in the form of a bell housing) or to just part 2" of the pump body 2 (FIGS. 1, 7 and 12).

More specifically, in structural and functional terms, the invention advantageously makes provision that the cam element 9 and the shutter element 8 by collaboration form a telescopic tubular assembly of which the longitudinal axis coincides with that AL of the shaft 6 of the impeller 5 and which can pass from a fully-retracted configuration in which the shutter element 8 does not in any way cover the exterior periphery 5' of the impeller 5 and is substantially completely pulled back around the cam element 9, to a fully-deployed configuration in which the shutter element 8 substantially completely covers the exterior periphery 5' of the impeller 5 and extends predominantly as an overhang beyond the cam element 9, the reversible transition from one configuration to the other taking place progressively and proportionally according to the rotational position of the cam element 9 about the axis AL (FIGS. 1A and 1B and FIGS. 7A and 7B).

As a preference, in the fully deployed position, only an end annular part of the shutter element 8 remains fitted onto the cam element 9, whereas in the fully retracted position, the shutter element is fitted over the cam element 9 so that it overlaps over substantially its entire height (dimension along the axis AL).

As shown particularly by FIGS. 1, 2, 6, 7, 10, 11 and 12, according to one preferred structural feature of the invention, the cam element 9, the shutter element 8 and the impeller 5 with its shaft 6 are all mounted on one and the same part 2" of the pump body 2, with which the receiving housing 7 also forms an integral part.

This then yields a construction that groups all of the functional components together into one same structural support component.

In addition, the invention advantageously makes provision for the impeller 5 to be mounted with overhang on a free end portion of the drive shaft 6 extending beyond the receiving housing 7.

In order to obtain a construction the bulk of which is reduced as far as possible, the invention may further make provision for the cam element 9 to be mounted directly around said receiving housing and to the rear of said impeller 5 and advantageously to have a radial extension at most substantially equivalent to that of said impeller 5.

For structural optimization purposes, the cam element 9 and the shutter element 8, both having hollow cylindrical overall shape, have substantially equivalent dimensions along their common axis, said at least one guideway 11 formed on the external face 9" of the wall 9' of the cam element 9 extending in the axial direction AL of said cam element 9, over the majority, preferably over substantially the entirety, of the axial length of this element 9.

As illustrated by way of preferred structural examples in the attached figures, the elements 8 and 9 have overall shapings similar to rings or sleeves, with cylindrical lateral walls 8', 9' on which the various means for the mutual collaboration, drive and guidance of said elements are advantageously formed, as one piece.

As also shown by the attached figures, the receiving housing 7 advantageously consists of a cylindrical tube formed of one piece with the wall of the pump body 2, or the main part 2" thereof. This cylindrical tube 7 receives, inside of it, the shaft 6 of the impeller 5 with its rotary bearing 6' and, on the outside, bears the elements 8 and 9 at least. As shown for example in FIGS. 1A and 1B, the cylindrical tube that forms the housing 7 that passes through the wall of the pump body 2 may also extend as a projection toward the outside of the pump body 2 to form a sufficient length of housing for the bearing for the shaft 6 without protruding too far into the internal volume (circulation chamber 3). The shaft 6 may for example, on its portion opening to the outside, bear a drive pulley 6".

Thus, the progressive nature of the translational movement of the shutter element 8 can be optimized.

According to one advantageous practical embodiment, the hollow cylindrical shutter element 8 comprises at least two, preferably three, follower elements 12, for example in the form of studs, pins, fingers or the like, projecting toward the inside and evenly distributed on its circumference, the or each guideway 11 consisting of a groove or slot extending over a fraction or over the entirety of one turn, or even over several turns in the case of a single guideway, on the exterior face 9" of the wall 9' of the cam element 9.

In certain fields of application it is compulsory, for safety reasons, to be able to guarantee a given pump status and therefore a determined position of the shutter element 8 in the event of failure of the actuator 10.

For that purpose, provision may be made that the assembly formed by the shutter element 8 and the cam element 9 is urged by an elastic means (not depicted) into a state corresponding to the exterior periphery 5' of the impeller 5 being completely uncovered by the shutter element 8 with, where appropriate, also the supply inlet 4 and the discharge outlet 4' of the circulation chamber 3 being completely uncovered also, said elastic urging being provided by a means acting in rotation on the cam element 9 or in translation on the shutter element 8 or incorporated into the actuator.

Figure 1B:
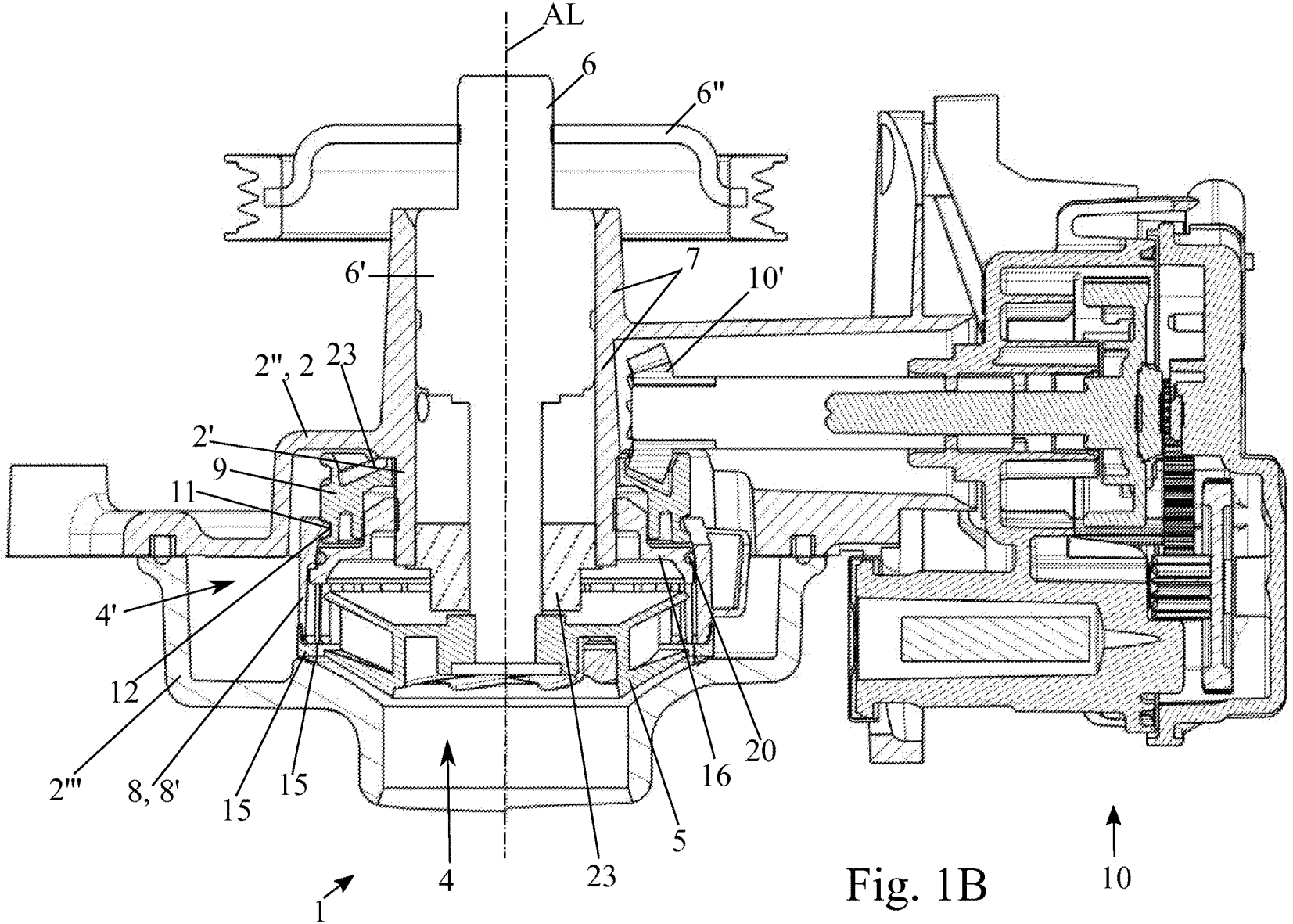
Figure 2:
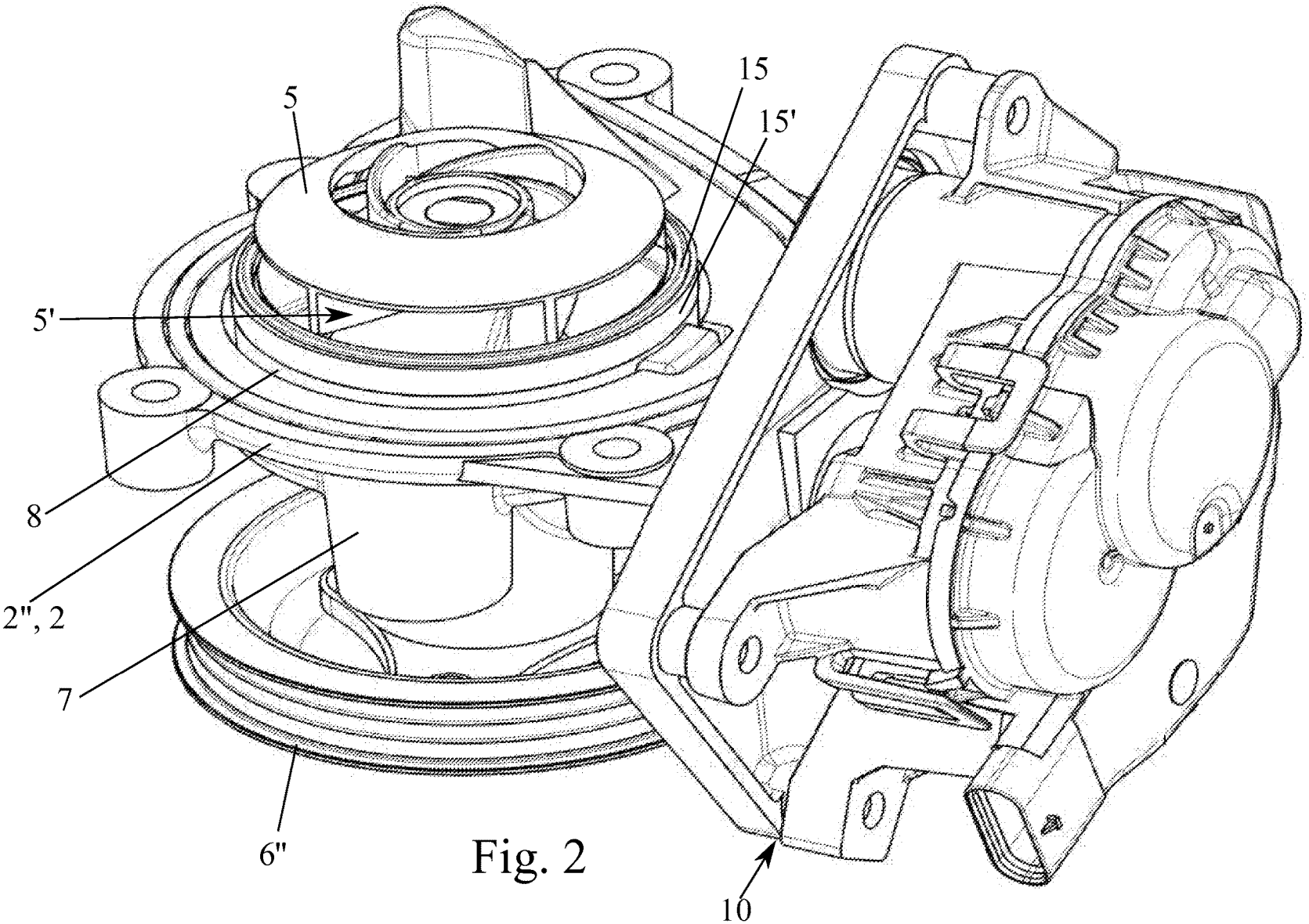
FIG. 2 is a perspective view of a pump device as depicted in FIGS. 1A and 1B.
Figure 3:
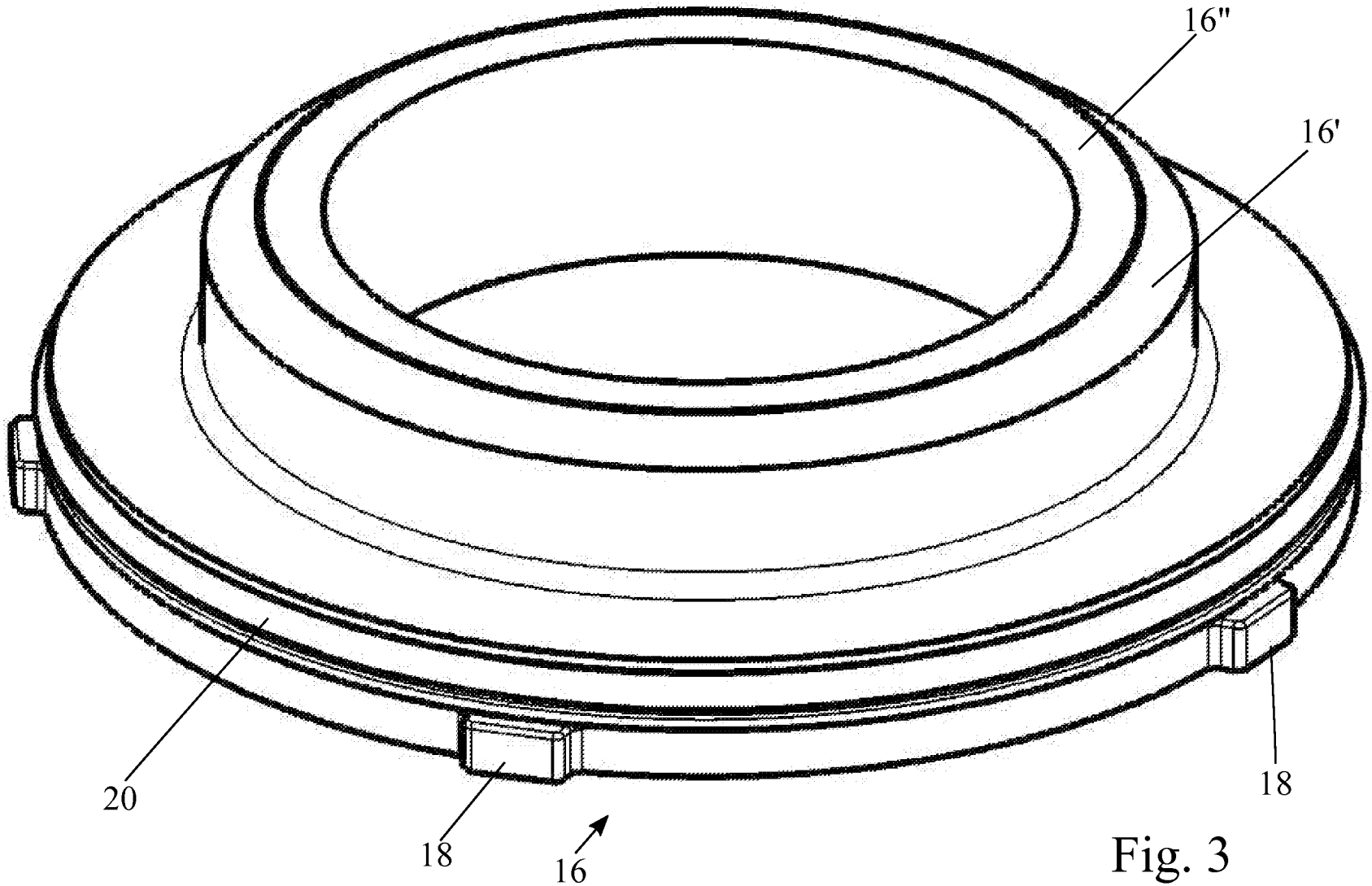

In order to be able to guarantee achieving a status with zero circulation, whether or not the impeller 5 is being driven, the invention may propose, as shown for example by FIGS. 1B, 11B and 12, that, in the deployed position of maximum coverage of the exterior periphery 5' of the impeller 5 by the shutter element 8, the latter also in a sealed manner shuts off the discharge outlet(s) 4' of the circulation chamber 3, this or these outlet(s) being arranged radially with respect to the longitudinal axis AL of rotation of the impeller 5, on the exterior periphery of the toroidal internal volume of the distribution chamber 3 extending around the impeller 5, the supply inlet 4 opening into said chamber 3 facing the impeller 5 in the direction of the longitudinal axis AL.

Particularly in order to be able to achieve the aforementioned function, the hollow cylindrical shutter element 8 may comprise, at its frontal peripheral edge 14, a sealing means 15 able and intended to come into contact with an opposite wall portion of a secondary part 2'" of the pump body 2 or with an engine casing element 2'" (as depicted in FIGS. 1A and 1B) when the shutter element 8 is in the fully deployed position, with, simultaneously, complete covering of the exterior periphery 5' of the impeller 5 and, where appropriate, sealed shutting-off of the discharge outlet or outlets 4' of the circulation chamber 3. As shown more particularly in FIG. 7, this sealing means 15 in the form of a compression seal may, for example, be overmolded on a support ring 15' able to be secured by welding to the frontal edge 14 of the shutoff element 8 or overmolded.

In the alternative in which the water pump device 1 is, in the case of the preferred application of the invention, an independent module attached to the engine casing 2'", the seal 15 comes to bear on a wall portion of a secondary part 2'" of the pump body 2 which is situated facing the impeller 5.

In order to provide reliable and precise guidance of the shutter element 8, the pump device 1 further comprises at least one attached or inbuilt specific means 16, 17, 25 for axially or linearly harnessing the movement of the shutter element 8 in addition to its translational harnessing resulting from the fact that it is mounted with the ability to slide on the cam element 9, this being done by way of a translation-guiding rotation-blocking connection between the shutter element 8 and the pump body 2 (FIGS. 1, 2, 4, 6, 7 and FIGS. 11 and 14 to 16).

Such a movement of the shutter element 8 solely in translation on the axis AL preferably with multiple guide zones, also allows the seal 15 to bear uniformly and frontally when said element 8 is in the deployed state.

According to one first embodiment illustrated in FIGS. 1 to 10, the harnessing means 16 consists of an annular flange which is rigidly secured to the receiving housing 7 receiving the shaft 6 of the impeller 5, this being by means of an internal tubular extension 16' that also forms a rotational-guidance bearing for the cam element 9 and which on its exterior periphery comprises projecting and/or indented radial formations 18 collaborating with complementary sites 19 formed on the internal face 8" of the cylindrical wall 8' of the shutter element 8. Said projecting and/or indented sites 19 have a structure that is elongate and profiled in the axial direction AL of the cylindrical shutter element 8 and said formations 18 slide along said sites 19 during translational movement of the shutter element 8 under the effect of the rotation of the cam element 9, this flange 16 thus providing rotation-blocking and translation guidance for said shutter element 8.

As a preference, the formations 18 and the sites 19 have mutually complemented crenelated shapes, thus providing engagement and guidance over the entire circumference.

In order to be able, when the edge 14 is provided with a seal 15, to provide a construction in the form of a bell housing when the shutter element 8 is in the fully deployed state and bearing against the corresponding part of the wall of the pump body 2, able to define a sealed volume (the receiving housing 7 itself being sealed), the annular flange 16 may comprise, on its exterior periphery, a seal 20 to seal against the internal face 8" of the cylindrical wall 8' of the shutter element 8 (FIGS. 1A, 1B, 4 and 8B).

Furthermore, in order to ensure a precise and strong assembly of the [elements 8 and 9 and flange 16] assembly on the receiving housing 7, provision may be made for the tubular extension 16' of one piece with said flange 16 to comprise an internal metal insert 16" of annular shape over which it is overmolded. The extension 16' with the insert 16" thus constitutes a strong and low-clearance rotary mounting bearing for the cam element 9.

According to another embodiment of the invention, evident from FIGS. 7 to 11, the harnessing means 17 may consist of projecting and/or reentrant guideways formed in a wall part 2' of the pump body 2 surrounding the shutter element 8, extending parallel to the direction of the longitudinal axis AL of the shaft 6 of the impeller 5 and with which they engage, with the ability to slide, projecting and/or reentrant formations 17' present on the external face 8'" of the cylindrical wall 8' of the shutter element 8.

Advantageously, the guideways 17 consist of straight slots parallel to the axis AL of the shaft 6 of the impeller 5 and each formed on the internal face of the wall part 2' of the pump body 2 (FIG. 10), and the external formations 17' of the shutter element 8 consist of ribs designed to be received in the slots 17 of the pump body 2.

In this embodiment also, a shut-off (but not axial-guidance) flange 16 and a tubular metal insert 16", forming a rotary mounting bearing for the cam element 9, may be provided.

According to another embodiment (FIG. 11), the slots are not machined or formed directly on the pump body 2 but are formed on an insert 21 made of plastic of the PTFE (polytetrafluoroethylene) type which is for example mounted tightly in the aforementioned wall part 2' of the pump body 2.

Figure 11:
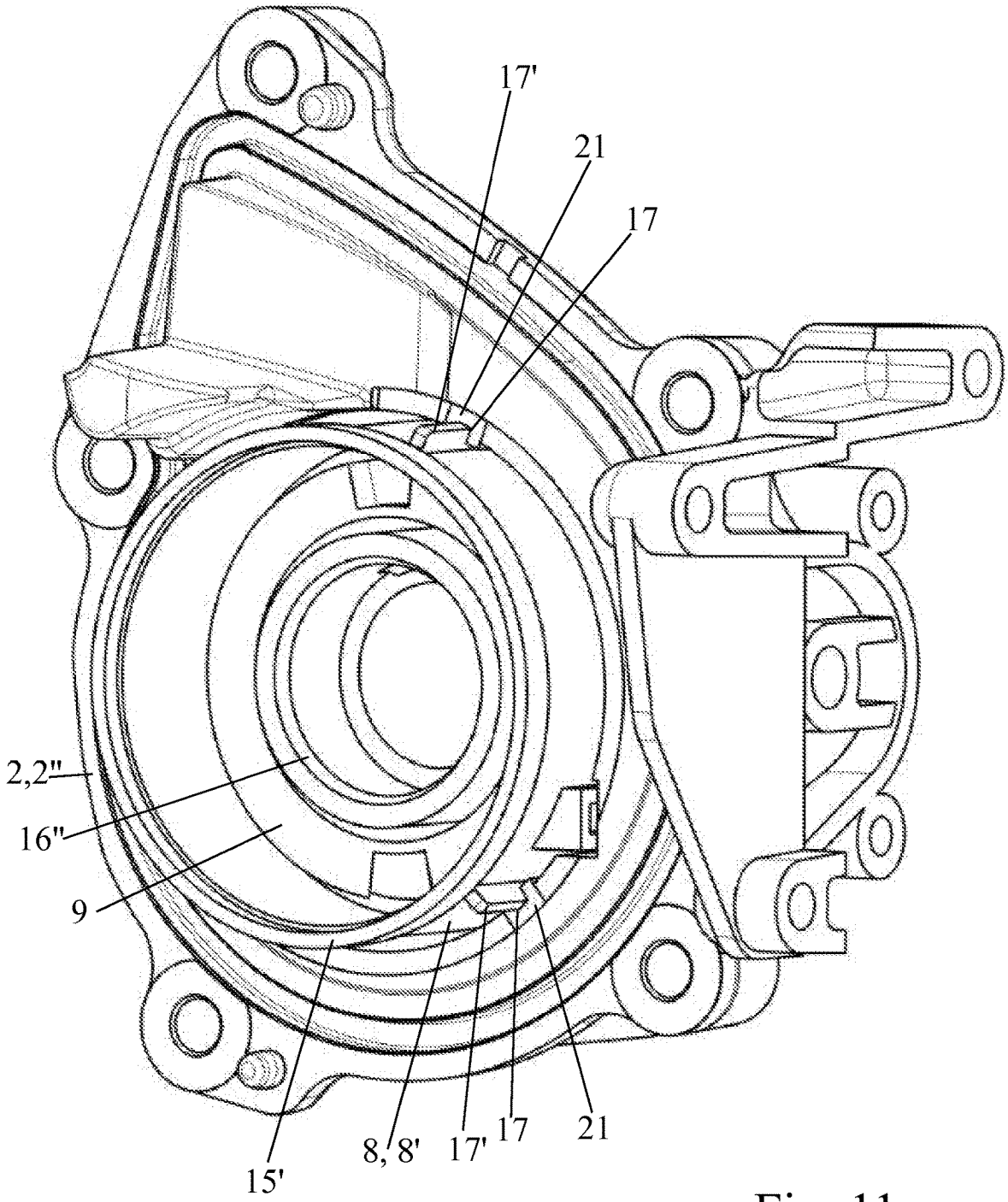
FIG. 11 is a perspective view, similar to that of FIG. 10, of a variant embodiment of the object depicted in the latter figure.

More specifically in the latter case, the guideways 17 are formed on or in an insert piece 21 attached by insetting inside the pump body 2 around the receiving housing 7 for the shaft 6 of the impeller 5 and against or in a wall part 2' of the pump body 2 surrounding the shutter element 8 (FIG. 11).

According to yet another embodiment illustrated by way of example in FIG. 12, a U-section annular insert piece 25 may be mounted by insetting inside the pump body 2, around the cylindrical wall of the receiving housing 7 for the shaft 6 of the impeller 5 and against a wall part 2' of the pump body 2. The mutually-collaborating shutter element 8 and cam element 9 are then arranged in said insert piece 25. The cylindrical internal wall 25' of said insert piece 25 forms a support and rotation guiding surface for the cam element 9 and the cylindrical external wall 25" comprises harnessing means 17 in the form of projecting or reentrant guideways, formed in said wall 25", extending parallel to the direction of the longitudinal axis AL of the shaft 6 of the impeller 5 and with which they engage, with the ability to slide, projecting and/or reentrant formations 17' present on the external face 8'" of the cylindrical wall 8' of the shutter element 8.

According to an additional feature, the internal volume of the U-section annular insert piece 25 is closed by an annular flange forming a cover 26 coming to bear sealingly against the internal face of the cylindrical wall of the shutter element 8.

Said insert piece 25 with the shutter element 8, the cam element 9 and the annular flange 26 if appropriate may constitute a subassembly that is preassembled before being mounted in the pump body 2.

As shown notably in FIGS. 1, 2, 7, 9 and 12, the drive train transmitting the movement from the actuator 10 may comprise, in addition to potential reduction gearing 10", a drive pinion or gearwheel 10' meshing with an annulus gear 23 of the cam element 9, formed as one piece therewith and situated opposite to the frontal side 14 of the shutter element 8.

The rolling bearing 6' is mounted as a sealed and tight fit in the support bearing 7 formed as one piece with the main part 2" of the pump body 2. Furthermore, a seal 24 may be mounted between the spindle 6 and the receiving housing 7.

According to one first embodiment, the pump body 2 is advantageously made up of a part 2" notably comprising the receiving housing 7 and forming a cover or bell housing, which is mounted on a part 2'" of an engine casing, notably comprising the supply inlet 4 and against which the shutoff element 8 comes to bear in the fully deployed position.

According to another embodiment, the water pump device 1 is an independent module and the pump body is made up of two parts 2" and 2'" assembled with one another sealingly at a parting plane, namely a main part (equivalent to 2") notably comprising the receiving housing 7 for the shaft 6 and a secondary part (equivalent to 2'") comprising the supply inlet 4 and on which the shutter element 8 comes to bear in the position of maximum coverage.

The elements 8 and 9 in particular are advantageously made of a resistant and hard plastic having a low coefficient of friction, such as PPS (polyphenylene sulfide). As a preference and is apparent particularly from the attached figures, these elements 8 and 9 take the form of single-piece components molded as one.

In order to be able to influence in a controlled manner the position of the shutter element 8 and therefore be able to master control of the delivery of the pump device 1, this device may further comprise a position sensor (not depicted) detecting the translational position of the shutter element 8, for example a magnetic sensor able to detect the position of a ferromagnetic marker incorporated into the shutter element 8. According to other forms of embodiment, the sensor may be incorporated into the actuator 10 in the form of an angular position sensor for the output shaft of the actuator 10.

Figure 4A:
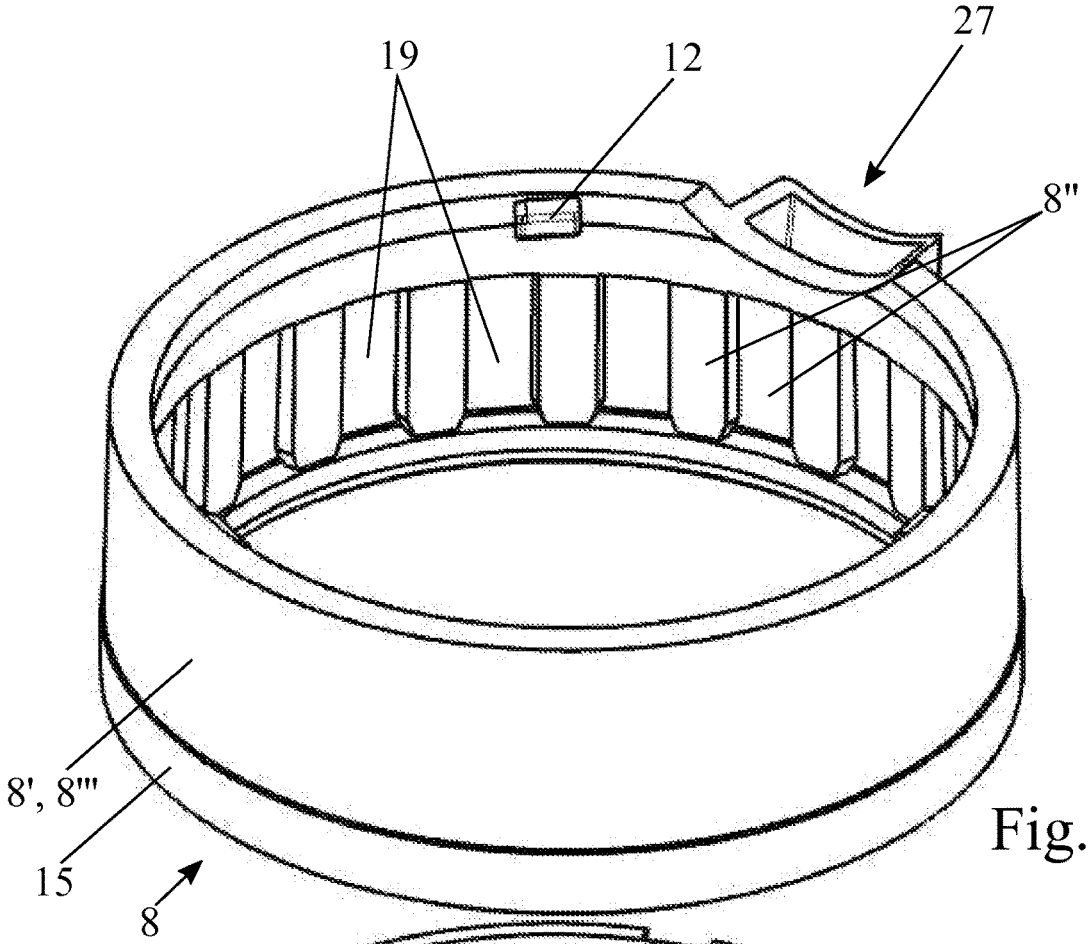
FIGS. 4A to 4C: views in perspective before (FIGS. 4A and 4B) and after (FIG. 4C) their assembly, of the elements of a [cam element/shutter element] assembly that forms part of the pump device.
Figure 4B:
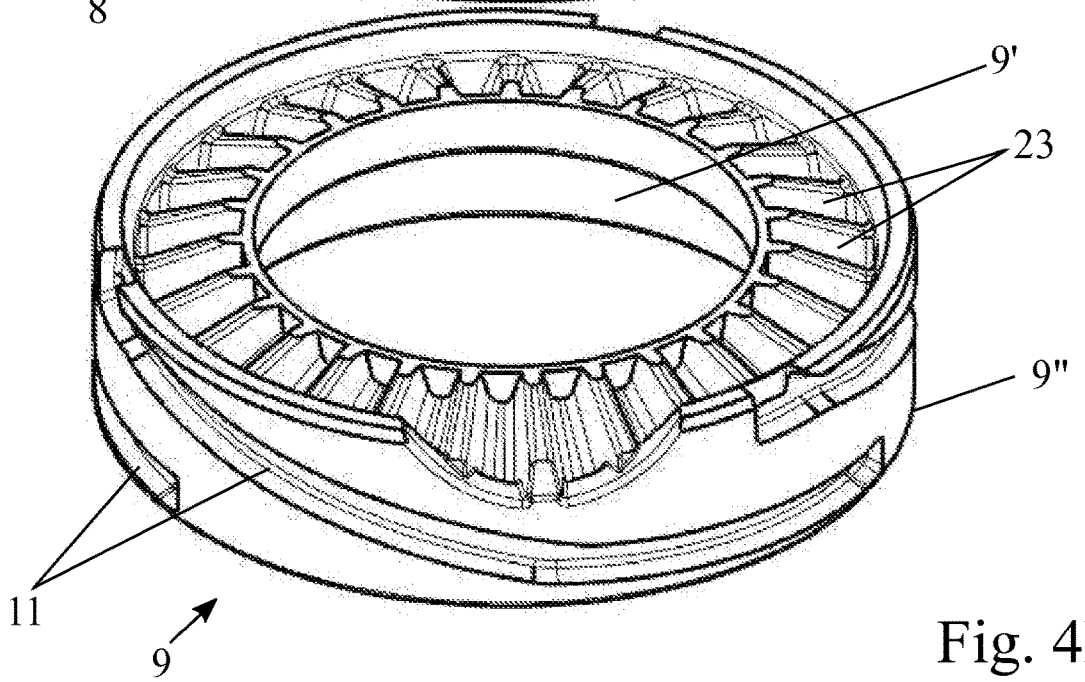
Figure 4C:
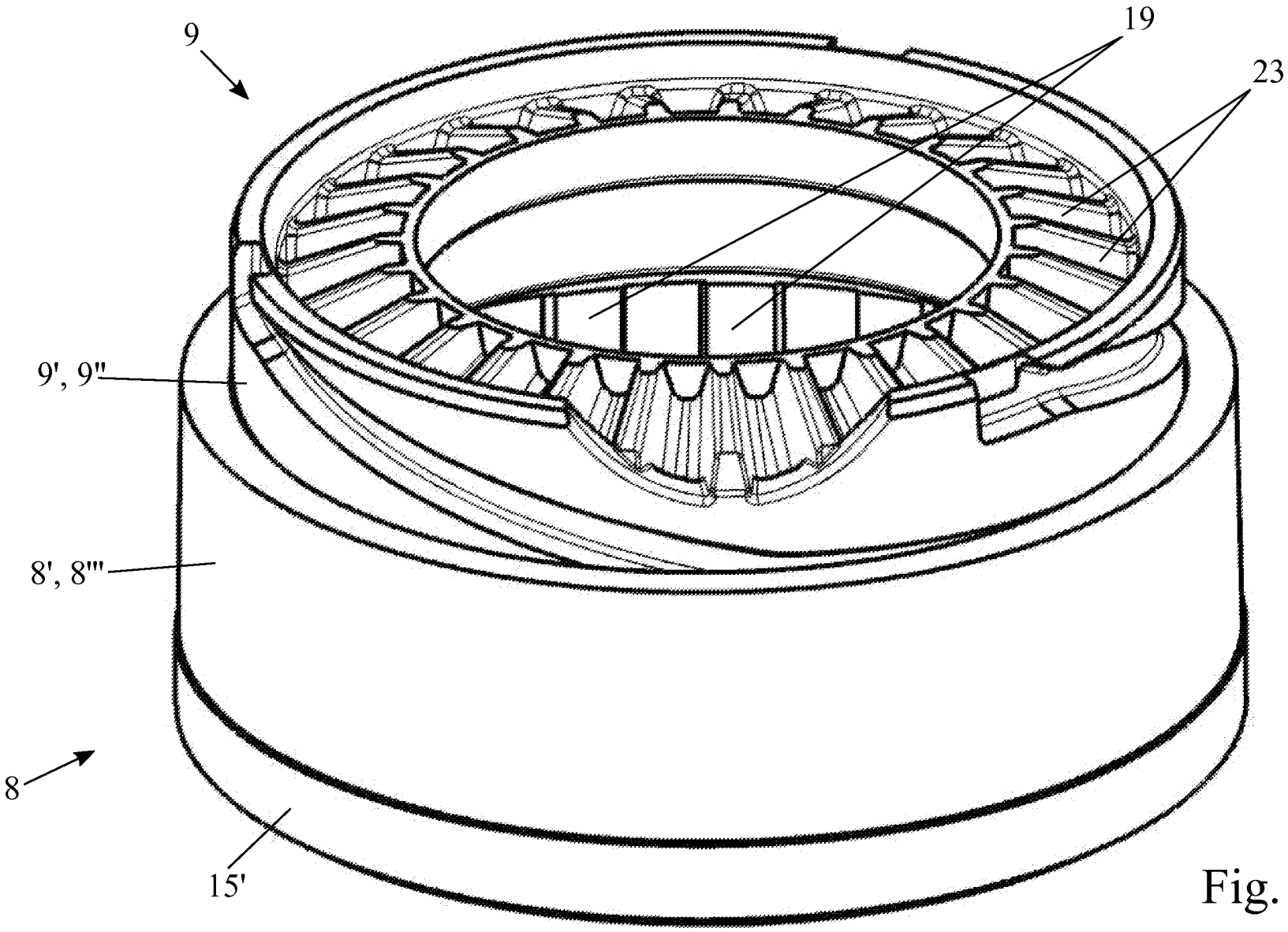
Figure 5:
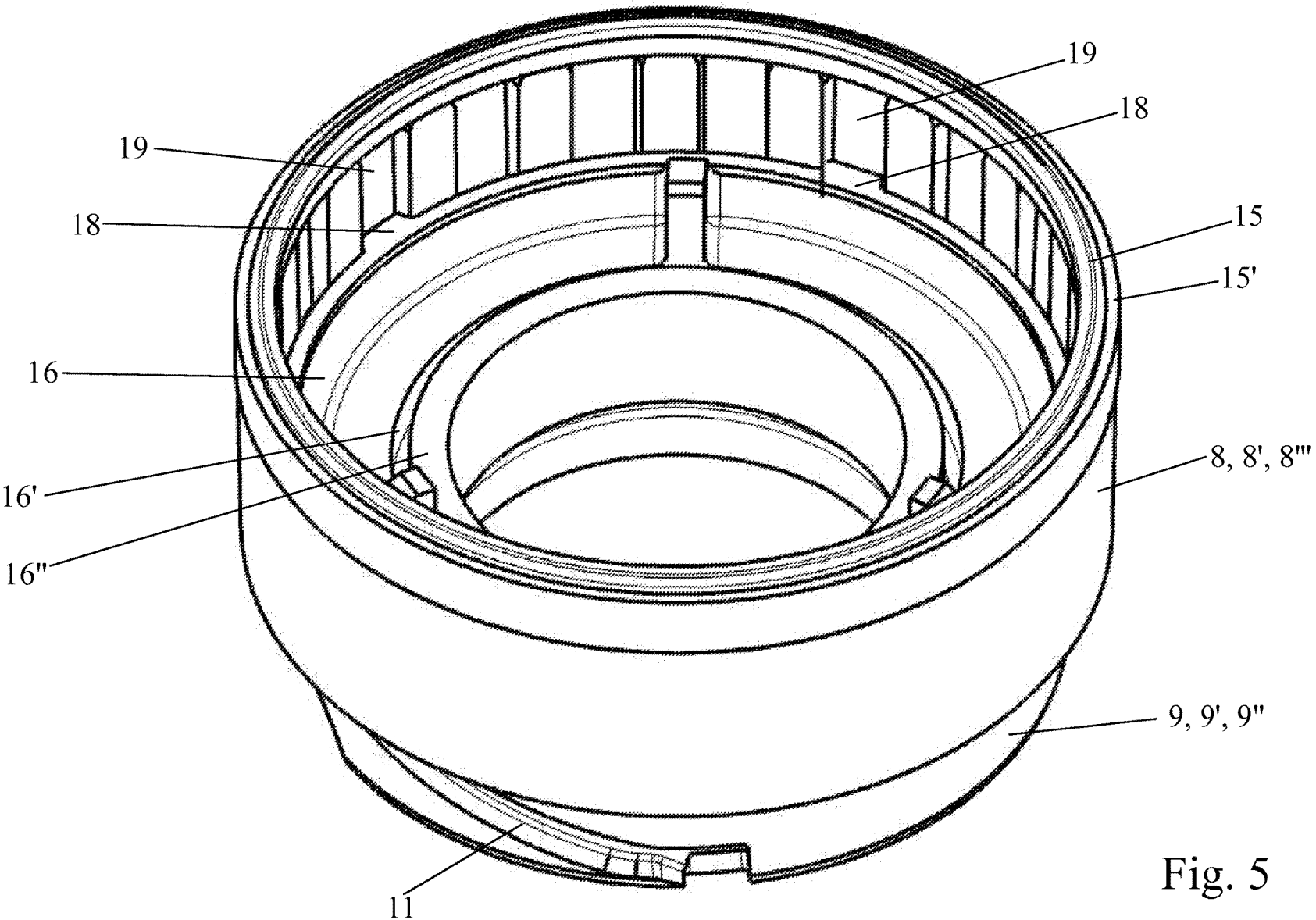
Figure 6A:
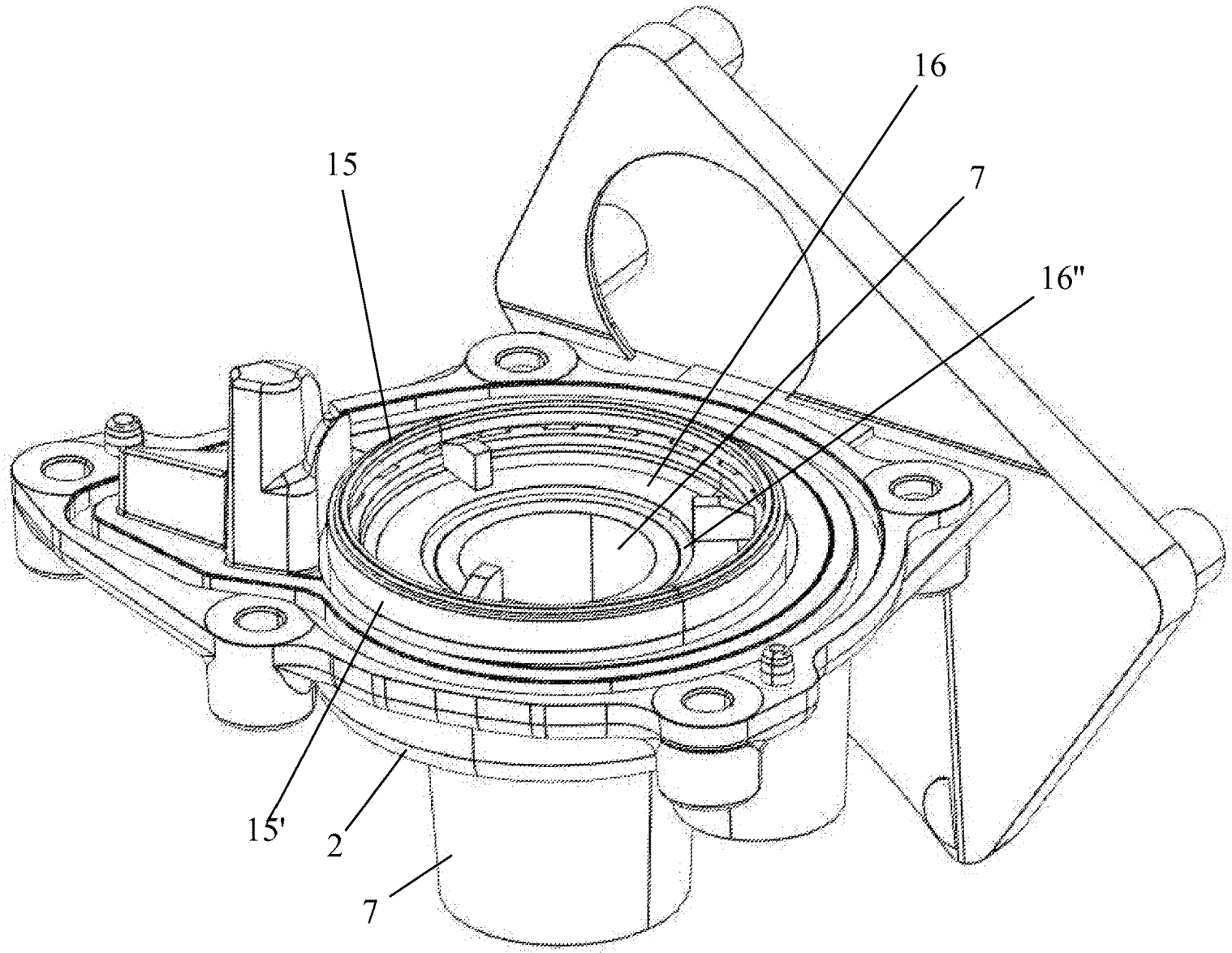
FIGS. 6A and 6B: views in perspective and in section of the main part of the pump body after the object depicted in FIG. 5 has been fitted and before the fitting of the impeller.
Figure 6B:
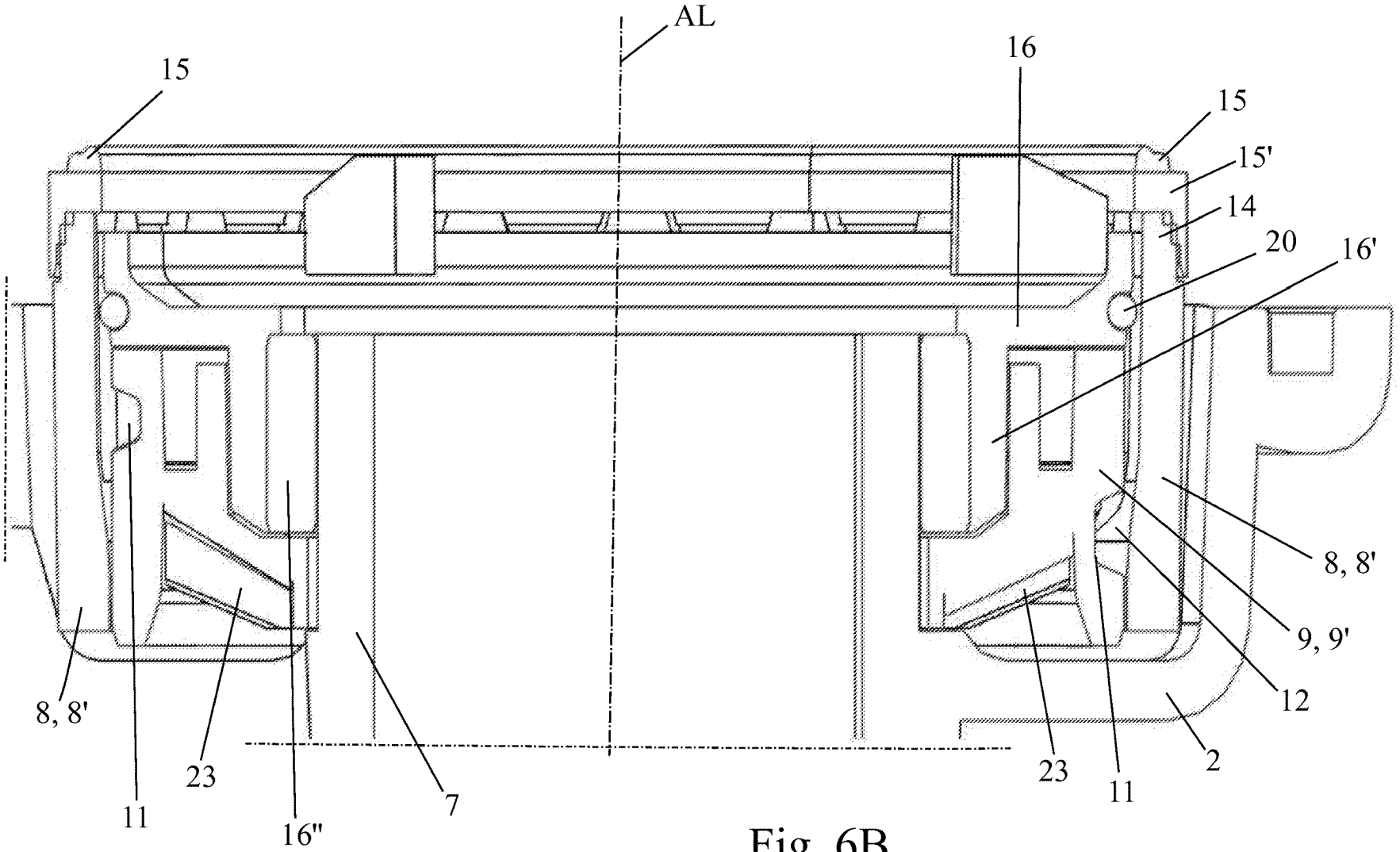
Figure 7A:
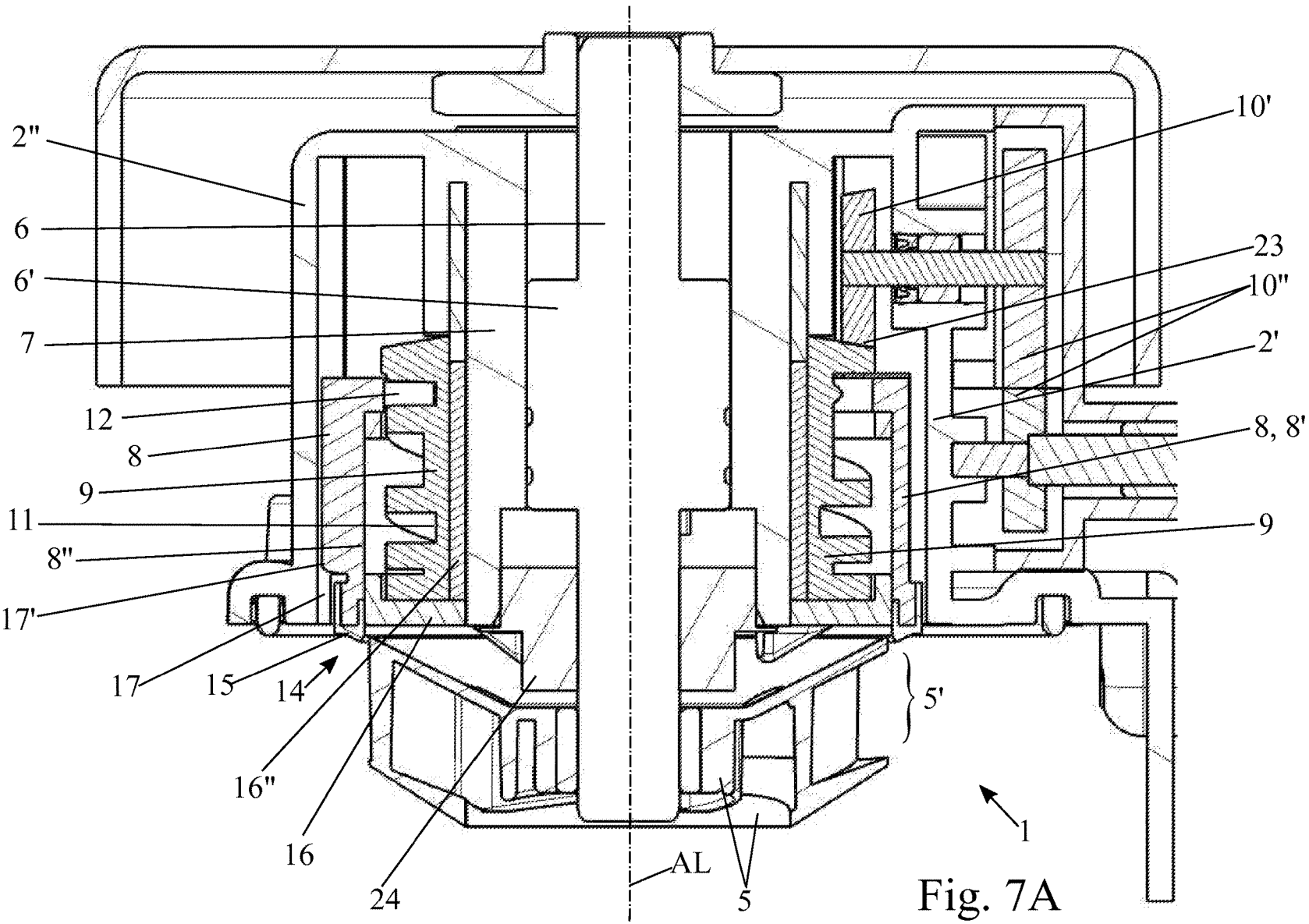
FIGS. 7A and 7B are views in section, on a plane that passes through the longitudinal axis of the shaft of the impeller, of a variable-delivery pump device according to a second embodiment, with the shutter element in the maximum retracted position (FIG. 7A) and in the maximum deployed position (FIG. 7B), the secondary part of the pump body being removed.
Figure 7B:
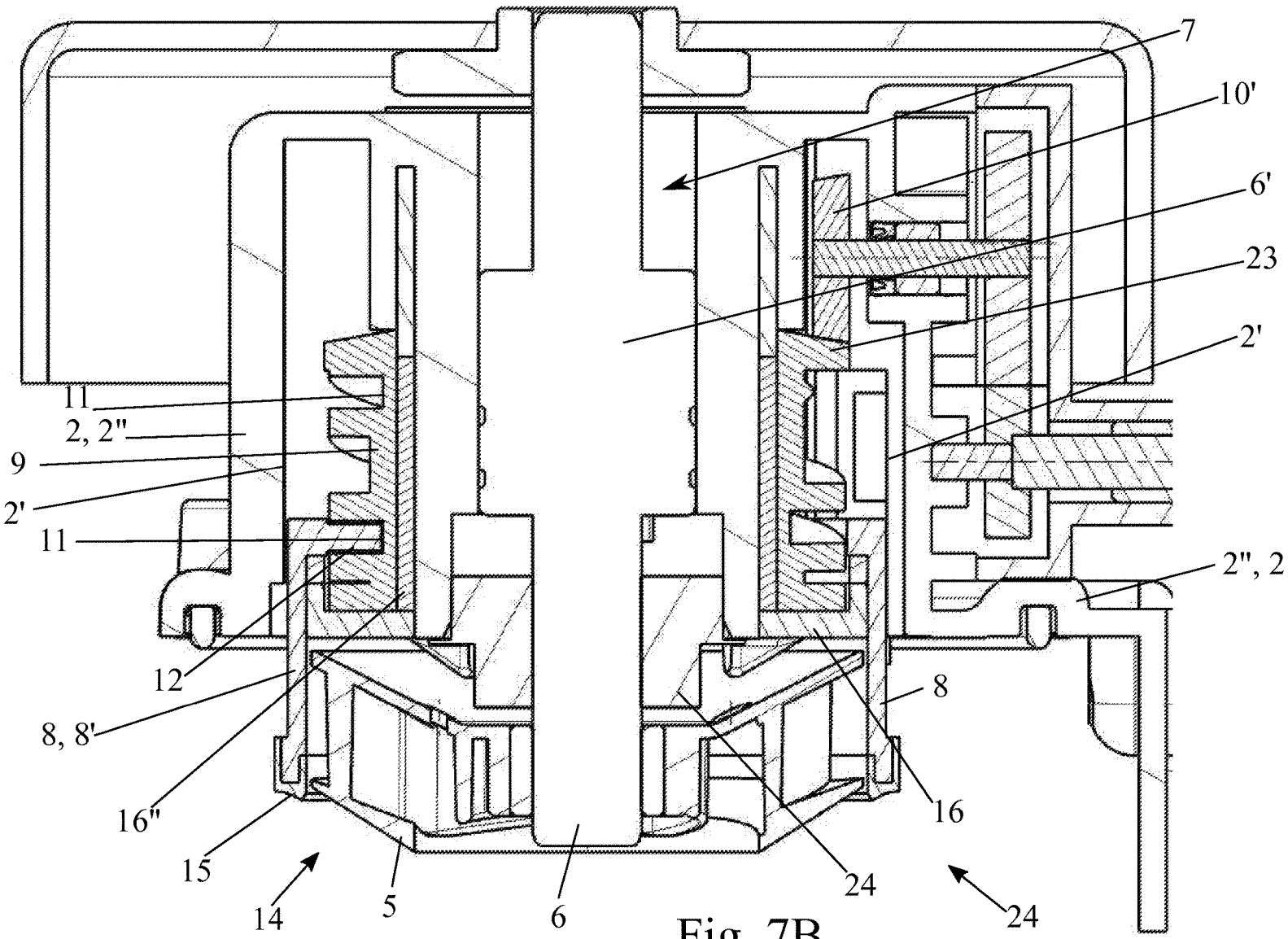
Figure 8:
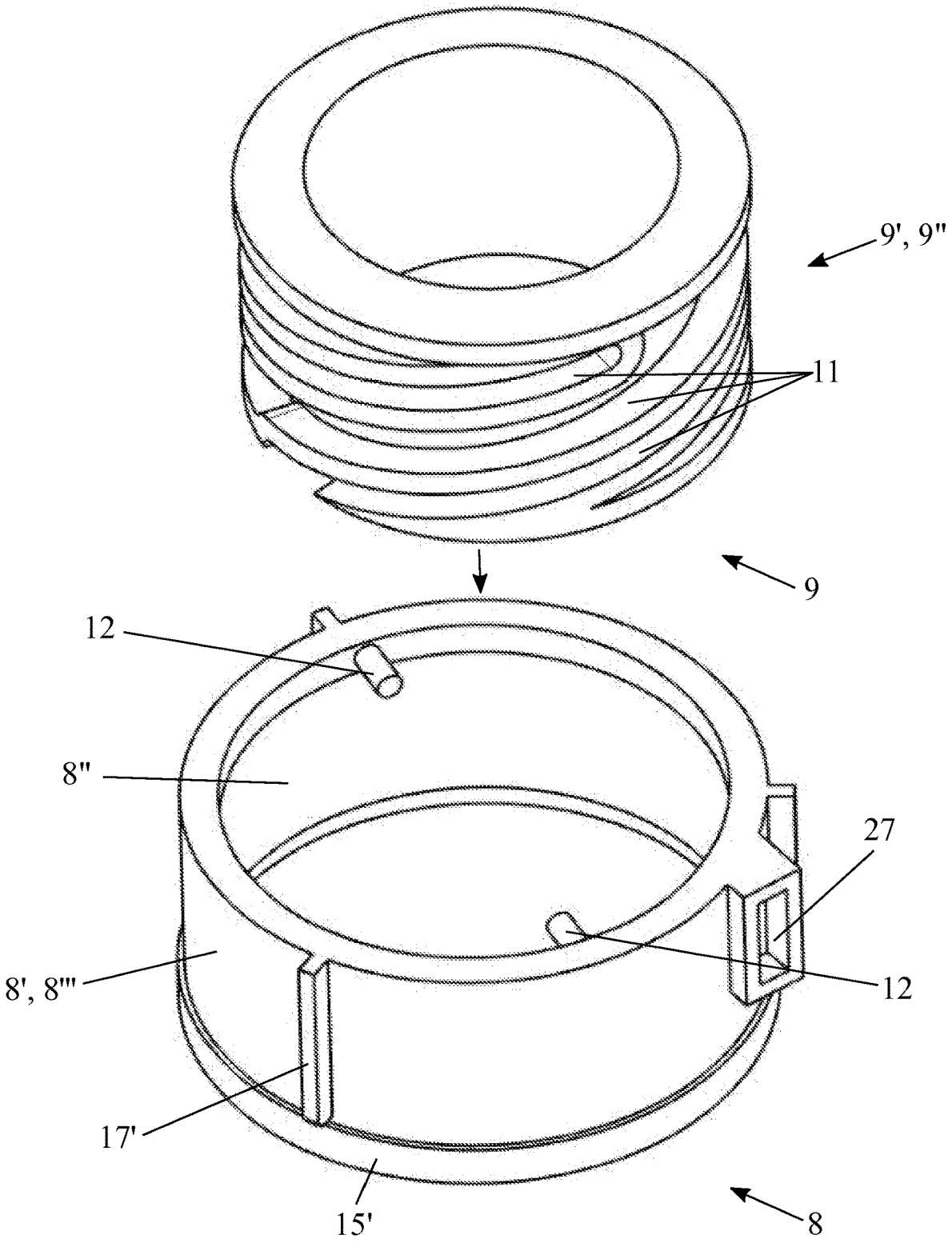
Figure 9:
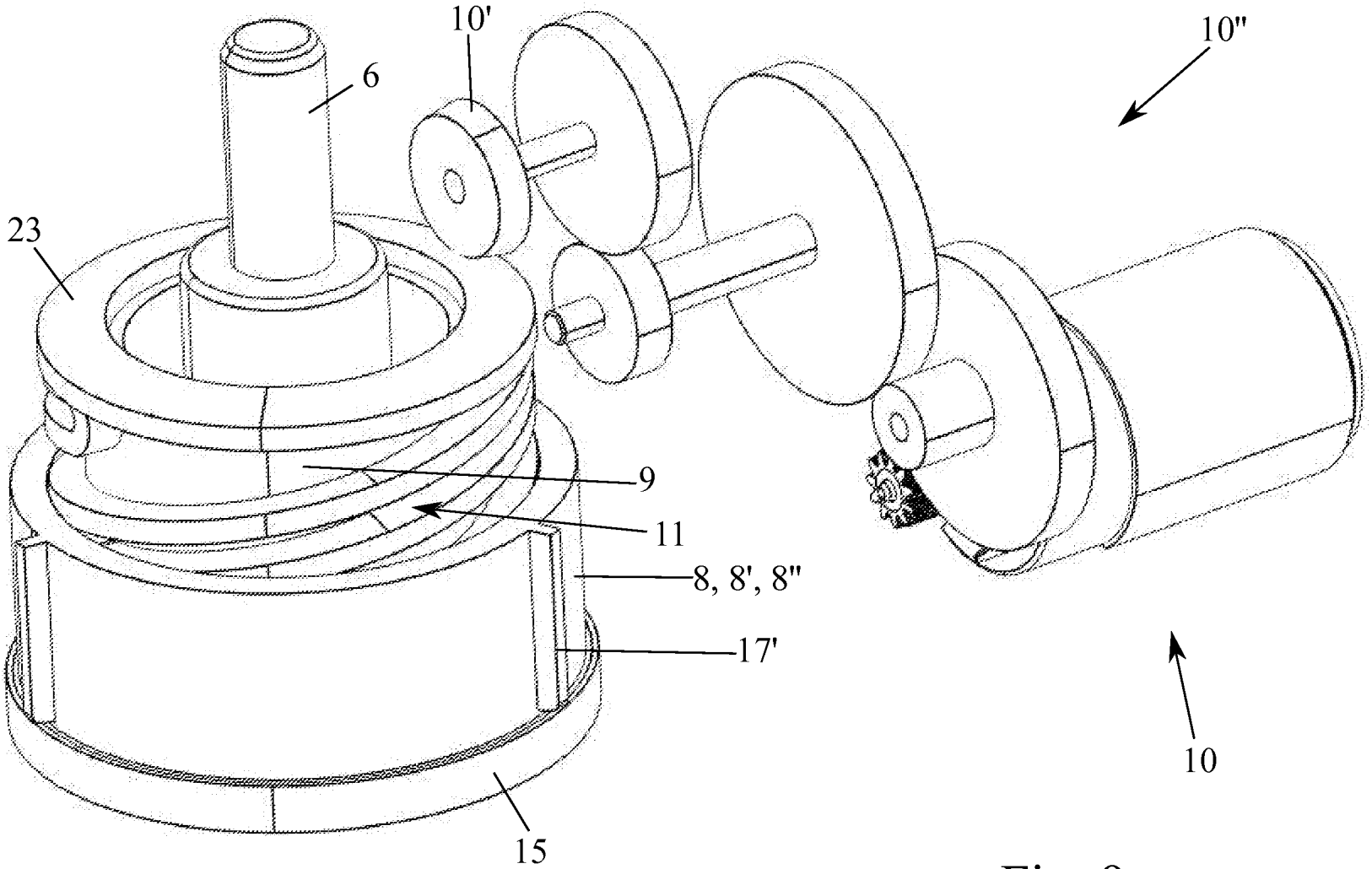
Figure 10:
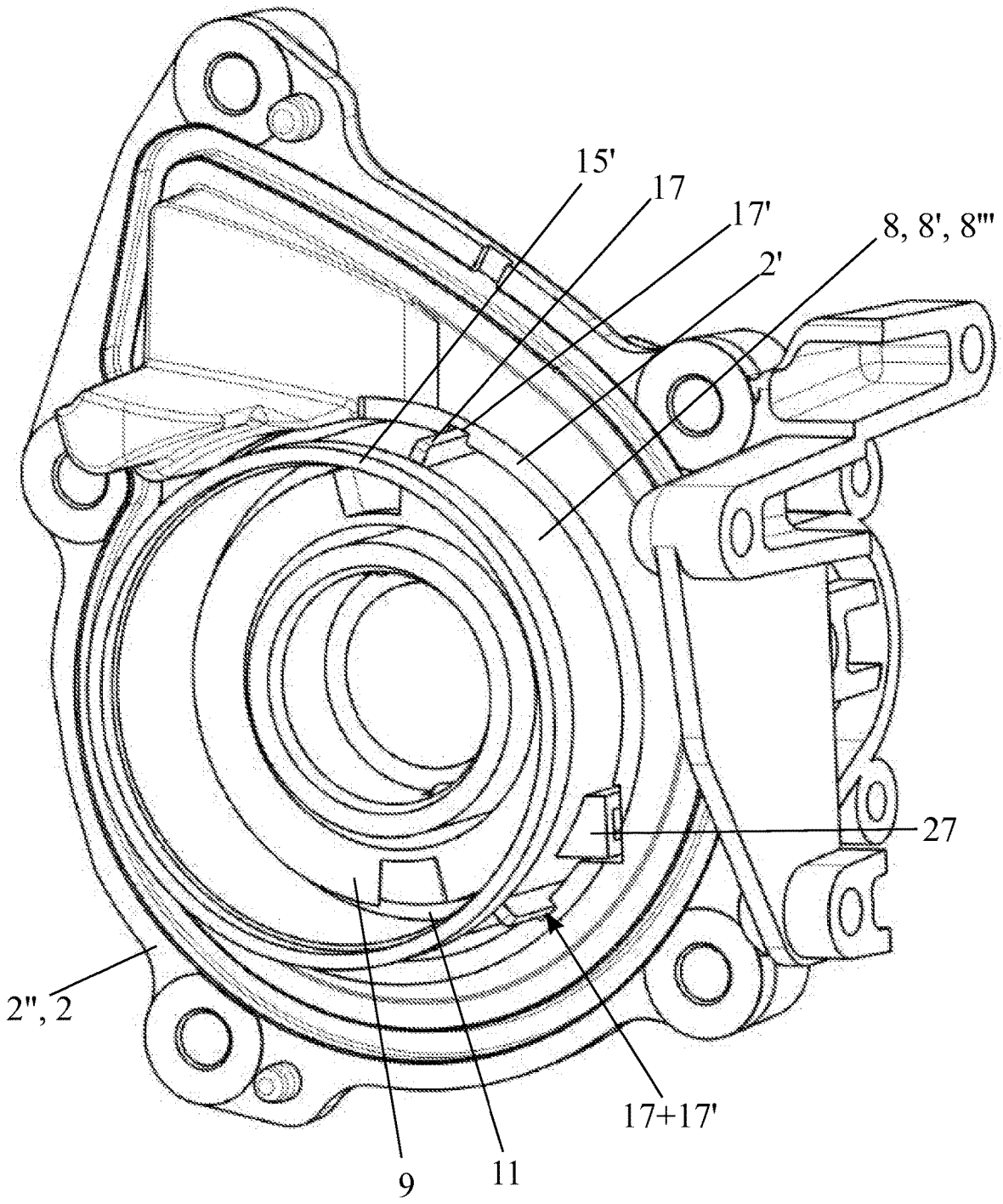

In order to be able to guarantee a minimal delivery when the shutter element 8 is fully deployed, possibly with support of the seal 15, provision may be made for said shutter element 8 to comprise at least a cutout or a passage 27 in its cylindrical wall 8' (cf. FIGS. 4B, 8 and 10).

The invention also relates to a vehicle, notably a motor vehicle, comprising at least one circuit for the circulation of a liquid fluid, such as, for example, a coolant circuit, characterized in that said circuit comprises at least one pump device 1 as described hereinabove.

Advantageously, the circuit may further comprise at least one means for measuring the temperature of the circulating liquid fluid, the measurement signal of which is exploited to control the actuator 10 driving the cam element 9 of the pump device 1.

Of course, the invention is not restricted to the embodiments described and depicted in the attached drawings. Modifications remain possible, notably from the standpoint of the makeup of the various elements or by substituting technical equivalents, without thereby in any way departing from the field of protection of the invention.

The invention claimed is:

1. A variable-delivery pump device comprising, on the one hand, a pump body defining, alone or in collaboration with a support body, a circulation chamber with at least one inlet and at least one outlet, on the other hand an impeller fixed to a drive shaft mounted with the ability to rotate in the pump body at a receiving housing, this impeller being of substantially cylindrical or discoid overall shape and arranged in the circulation chamber and, finally, a shutter element, able to move in translation in the direction of a longitudinal axis of the drive shaft of the impeller in the chamber and covering, adjustably, according to an axial position of said shutter element, at least part of a exterior periphery of the impeller, a cam element, driven in rotation by an actuator and collaborating kinematically with said shutter element for the translational movement thereof, also being present inside the pump body, in which the pump device, the shutter element, and the cam element have cylindrical walls and in which the cam element has, on an external face of its wall, at least one helical guideway on which there circulates at least one corresponding follower element of the shutter element, said pump device, shutter element, and cam element thus, by collaboration, forming a mechanism for converting a rotary movement of the cam element about the longitudinal axis into a translational movement of the shutter element along this axis, wherein the shutter element and the cam element are arranged concentrically about the receiving housing forming part of the pump body and receiving the shaft of the impeller, in that the rotary cam element is situated inside the shutter element, in that the follower element at least present is secured to an internal face of the wall of the shutter element, and in that the cam element and the shutter element by collaboration form a telescopic tubular assembly having a longitudinal axis that coincides with the shaft of the impeller.

2. The pump device as claimed in claim 1, wherein the telescopic tubular assembly formed by the cam element and the shutter element is configured to pass from a fully-retracted configuration in which the shutter element does not in any way cover the exterior periphery of the impeller and is substantially completely pulled back around the cam element, the two elements then being arranged one inside the other, to a fully-deployed configuration in which the shutter element substantially completely covers the exterior periphery of the impeller and extends predominantly as an overhang beyond the cam element, the reversible transition from one configuration to the other taking place progressively and proportionally according to the rotational position of the cam element about an axis.

3. The pump device as claimed in claim 2, wherein in the fully deployed position of maximum coverage of the exterior periphery of the impeller by the shutter element, the shutter element also in a sealed manner shuts off discharge outlet(s) of the circulation chamber, this or these outlet(s) being arranged radially with respect to the longitudinal axis of rotation of the impeller, on the exterior periphery of the toroidal internal volume of the distribution chamber extending around the impeller, the supply inlet opening into said chamber facing the impeller in the direction of the longitudinal axis.

4. The pump device as claimed in claim 1, wherein the cam element, the shutter element and the impeller with its shaft are all mounted on one and the same part of the pump body, with which the receiving housing also forms an integral part.

5. The pump device as claimed in claim 1, wherein the impeller is mounted with an overhang on a free end portion of the drive shaft extending beyond the receiving housing, and in that the cam element is mounted directly around the free end portion of the drive shaft and to the rear of said impeller and advantageously has a radial extension at most substantially equivalent to that of said impeller.

6. The pump device as claimed in claim 1, wherein the cam element and the shutter element, both having hollow cylindrical overall shape, have substantially equivalent dimensions along their common axis, said at least one guideway formed on the external face of the wall of the cam element extending in an axial direction of said cam element, over the majority of the axial length of this element.

7. The pump device as claimed in claim 6, wherein the shutter element with a hollow cylindrical overall shape comprises at least two follower elements in the form of studs, pins, or fingers, projecting toward the inside and evenly distributed on its circumference, the or each guideway having a groove or slot extending over a fraction or over the entirety of one turn, or even over several turns in the case of a single guideway, on the exterior face of the wall of the cam element.

8. The pump device as claimed in claim 6, wherein the shutter element having a hollow cylindrical shape comprises, at its frontal peripheral edge, a sealing means able and intended to come into contact with an opposite wall portion of a secondary part of the pump body or of an element of an engine casing forming a support body when the shutter element is in a fully deployed position, with, simultaneously, complete covering of the exterior periphery of the impeller and, sealed shutting-off of the discharge outlet or outlets of the circulation chamber.

9. The pump device as claimed in claim 1, wherein the assembly formed by the shutter element and the cam element is urged by an elastic means into a state corresponding to the exterior periphery of the impeller being completely uncovered by the shutter element, and the supply inlet and the discharge outlet of the circulation chamber being completely uncovered also, said elastic urging by said elastic means being provided by a means acting in rotation on the cam element or in translation on the shutter element or incorporated into the actuator.

10. The pump device as claimed in claim 1, wherein said pump device further comprises at least one attached or inbuilt specific means for axially or linearly harnessing the movement of the shutter element in addition to said shutter element translational harnessing resulting from the fact that said shutter element is mounted with the ability to slide on the cam element, by way of a translation-guiding rotation-blocking connection between the shutter element and the pump body.

11. The pump device as claimed in claim 10, wherein the harnessing means has an annular flange which is rigidly secured to the receiving housing receiving the shaft of the impeller, this being by means of an internal tubular extension that also forms a rotational-guidance bearing for the cam element and which on an exterior periphery of said internal tubular extension comprises projecting and/or indented radial formations collaborating with complementary sites formed on the internal face of the cylindrical wall of the shutter element, in that said projecting and/or indented sites have a structure that is elongate and profiled in the axial direction of the cylindrical shutter element and in that said formations slide along said sites during translational movement of the shutter element under the effect of the rotation of the cam element, this flange thus providing rotation-blocking and translation guidance for said shutter element.

12. The pump device as claimed in claim 11, wherein the annular flange comprises, on its exterior periphery, a seal to seal against the internal face of the cylindrical wall of the shutter element, and in that the tubular extension of one piece with said flange comprises an internal metal insert of annular shape over which said tubular extension of one piece with said flange is overmolded.

13. The pump device as claimed in claim 10, wherein the harnessing means has projecting and/or reentrant guideways formed or attached in a wall part of the pump body surrounding the shutter element, extending parallel to the direction of the longitudinal axis of the shaft of the impeller and with which said projections and/or reentrant guideways engage, with the ability to slide, projecting and/or reentrant formations present on the external face of the cylindrical wall of the shutter element.

14. The pump device as claimed in claim 13, wherein the guideways have straight slots parallel to the axis of the shaft of the impeller and each formed on the internal face of the wall part of the pump body and in that the external formations of the shutter element have ribs designed to be received in the slots of the pump body.

15. The pump device as claimed in claim 13, wherein the guideways are formed on or in an insert piece attached by insetting inside the pump body around the receiving housing for the shaft of the impeller and against or in a wall part of the pump body surrounding the shutter element.

16. The pump device as claimed in claim 10, wherein a U-section annular insert piece is mounted by insetting inside the pump body, around the cylindrical wall of the receiving housing for the shaft of the impeller and against a wall part of the pump body, in that the mutually-collaborating shutter element and cam element are arranged in said insert piece, and in that the cylindrical internal wall of said insert piece forming a support and rotation guiding surface for the cam element and the cylindrical external wall comprises harnessing means in the form of projecting or reentrant guideways, formed in said wall, extending parallel to the direction of the longitudinal axis of the shaft of the impeller and with which said harnessing means they engages, with the ability to slide, projecting and/or reentrant formations present on the external face of the cylindrical wall of the shutter element.

17. The pump device as claimed in claim 16, wherein an internal volume of the U-section annular insert piece is closed by an annular flange forming a cover coming to bear sealingly against the internal face of the cylindrical wall of the shutter element, said insert piece with the shutter element, the cam element and the annular flange if appropriate constituting a subassembly that is preassembled before being mounted in the pump body.

18. The pump device as claimed in claim 1, wherein said pump device comprises a magnetic position sensor detecting the translational position of the shutter element, able to detect the position of a ferromagnetic marker incorporated into the shutter element or a sensor of the angular position of the output shaft of the actuator, incorporated into the actuator.

19. The pump device as claimed in claim 1, wherein the shutter element comprises at least a cutout or a passage in its cylindrical wall.

20. A vehicle, notably a motor vehicle, comprising at least one coolant circuit for the circulation of a liquid fluid, wherein said circuit comprises at least one pump device as claimed in claim 1.

21. The vehicle as claimed in claim 20, wherein the circuit comprises at least one means for measuring the temperature of the circulating liquid fluid, the measurement signal of which is exploited to control the actuator driving the cam element of the pump device.

* * * * *